United States Patent [19]

Gack et al.

[11] Patent Number: 4,790,395

[45] Date of Patent: Dec. 13, 1988

[54] PIPE-DRIVING APPARATUS

[75] Inventors: Helmut Gack; Gerhard Kaiser, both of Nürenberg, Fed. Rep. of Germany

[73] Assignee: Gewerkschaft Eisenhutte Westfalia GmbH, Fed. Rep. of Germany

[21] Appl. No.: 13,428

[22] Filed: Feb. 11, 1987

[30] Foreign Application Priority Data

Feb. 18, 1986 [DE] Fed. Rep. of Germany ..... 3605009

[51] Int. Cl.[4] ..... E21B 7/00; E21B 10/44

[52] U.S. Cl. ..... 175/102; 175/203; 175/309; 175/310; 299/56; 299/67

[58] Field of Search ..... 175/88, 99, 102, 161, 175/162, 203, 258, 259, 309, 310, 62; 299/56, 67, 68; 405/138, 154

[56] References Cited

U.S. PATENT DOCUMENTS

| | | | |
|---|---|---|---|
| 2,771,275 | 11/1956 | Ortloff | 175/259 |
| 2,915,288 | 1/1959 | Crapez | 175/102 |
| 2,919,121 | 12/1959 | Ruth | 175/99 |
| 3,603,411 | 9/1971 | Link | 175/259 |
| 3,604,754 | 9/1971 | Kampf-Emden | 175/88 |
| 3,672,726 | 6/1972 | House | 175/102 |
| 3,692,126 | 9/1972 | Rushing et al. | 175/259 |
| 3,938,598 | 2/1976 | Watts | 175/102 |
| 4,398,845 | 8/1983 | Stuckmann et al. | 405/138 |
| 4,576,515 | 3/1986 | Morimoto et al. | 175/62 |

FOREIGN PATENT DOCUMENTS

| | | | |
|---|---|---|---|
| 0185857 | 7/1986 | European Pat. Off. | 405/138 |
| 2527599 | 1/1976 | Fed. Rep. of Germany | 405/138 |
| 0352774 | 10/1979 | Fed. Rep. of Germany . | |
| 2845316 | 2/1982 | Fed. Rep. of Germany . | |

*Primary Examiner*—Jerome W. Massie
*Assistant Examiner*—Terry Lee Melius
*Attorney, Agent, or Firm*—Samuels, Gauthier, Stevens & Kehoe

[57] ABSTRACT

Pipe-driving apparatus used to create a pipe line of small diameter uses a pressing station in an access trench to drive in pipe sections one by one. A boring head and conveyor worm operates at the front of the pipe line in a working pipe section on which a cutting shoe is swivably mounted. The worm is a spiral flight on a drive shaft which runs within an open fronted container on which a drive unit for the boring head and the worm is mounted. Hydraulic bracing units mounted to the container can be swung out and engaged with stops in the working pipe section to brace the container during the filling operation. Projections on the container engage with the shoe and the bracing units can be used to steer the shoe. When the container is filled the bracing units re stowed and the container is withdrawn back down the pipe line to the access trench for discharging the material.

20 Claims, 3 Drawing Sheets

PIPE-DRIVING APPARATUS

FIELD OF THE INVENTION

The present invention relates to pipe-driving apparatus for driving a succession of pipe sections end-to-end to form a pipe string.

BACKGROUND OF THE INVENTION

Pipe-driving apparatus is known in which an open access trench accommodates a pressing station for thrusting individual pre-fabricated pipe sections end-to-end to extend the pipe string. At the forward end of the pipe string material is excavated with a boring head. Normally the pipe section would have a small diameter such as not more than 1200 mm and generally below 800 mm which makes access difficult. It is known from AT-PS 35 27 74 to remove material from the forward end zone with a container which is movable between a filling position in the forward end zone and a discharge position at a rear end zone in the access trench. The container supports the boring head as well as an associated conveyor worm which extends inside the container. A drive unit for the boring head and the worm is mounted at the rear of the container. This makes the container rather bulky and it is difficult to hold the container in its working position. DE-PS 2 845 316 describes a modified arrangement where the boring head can be separated from the container when the latter is to be removed for unloading. However, if it is desired to repair or replace the boring head this is a difficult operation with a small diameter pipe string.

A general object of the present invention is to provide an improved form of pipe-driving apparatus.

SUMMARY OF THE INVENTION

Pipe-driving apparatus constructed in accordance with the invention comprises a pressing station in an access zone for thrusting a succession of pipe sections end-to-end to form a pipe string, a working pipe section at the front end of the pipe string defining a working zone, cutting means and a conveyor worm at the working zone for detaching material from a working face and for conveying such material away from the face, a displaceable container operably associated with the cutting means and the conveyor worm to receive said material, the container being movable between the working and access zones to transfer the material, a drive unit for driving the cutting means and the conveyor worm, the drive unit being supported by the container and bracing means which selectively co-operates with the working pipe section to brace the container and hold the container in position whilst it is filled with material.

The bracing means can be in the form of piston and cylinder units orientated predominantly axially of the pipe string which can be swivelled in and out radially of the string to adopt inoperative and operative positions. A transverse piston and cylinder unit can effect the adjustment of the bracing units. In the operative position the bracing units can locate with stop means on the inside of the working pipe section. This section then forms an abutment for the forces of the bracing units when these urge the container forwardly.

Conveniently, the working pipe section, which is best made of a stout steel structure also mounts a cutting shoe which effectively terminates the pipe string. The shoe preferably has some angular mobility on the working pipe section. The shoe may have a shoulder or flange against which projections or the like on the container can be thrust with the bracing units. This enables the bracing units to control the position of the shoe and axial adjustment means or other measures can be adopted to permit the shoe to be steered to control any deviation in the direction the pipe string is following. The container can be reliably held in position by the bracing units whilst it is filled with spoil detached by the boring head and conveyed by the worm. Reactive forces can be transferred to the pipe string via the working pipe section. When it is desired to withdraw the container for unloading the bracing units can adopt the stored inoperative position.

Preferably, a selective coupling serves to connect the boring head to a drive shaft extending through the container. A spiral flight on the drive shaft then constitutes the conveyor worm at least in part. The selective coupling permits the container to be withdrawn without taking the boring head with it. Another characteristic of the invention adapts the boring head to have a variable effective diameter larger or smaller than the internal diameter of the pipe string. In this way if it is desired to remove the boring head it can be collapsed and locked to the shaft to move with the container. Otherwise the boring head can remain in place in its operative condition while the container is removed and unloaded. Since it is not possible to gain direct access to the boring head via the pipe string provision can be made to fit different tools to the drive shaft to interengage with components of the boring head to perform different operations. Thus, it is possible to rotatably connect the boring head to the drive shaft while allowing axially separation or to axially lock the boring head and the drive shaft or to adjust the operating state of the boring head between its fully expanded and fully collapsed states.

A further preferred feature of the invention is to provide means for adjusting the conveyor worm or spiral flight relative to the container. This means which can take the form of a piston and cylinder unit mounted inside the drive shaft, permits the worm to compress material in the container or to extend the boring head further forwards.

The worm can be composed of a spiral flight section on the drive shaft running substantially the entire length of the container and a short flight section between the boring head and an open end of the container. The selective coupling then operates between these respective flight sections.

Pipe-driving apparatus constructed in accordance with the invention can be adapted more satisfactorily to the prevailing conditions and time consuming and cumbersome tasks can be minimized to increase the efficiency of the operation.

The invention may be understood more readily, and various other aspects and features of the invention may become apparent, from consideration of the following description.

BRIEF DESCRIPTION OF THE DRAWINGS

Embodiments of the invention will now be described, by way of examples only, with reference to the accompanying drawings, wherein.

DESCRIPTION OF PREFERRED EMBODIMENTS

Figure 1:
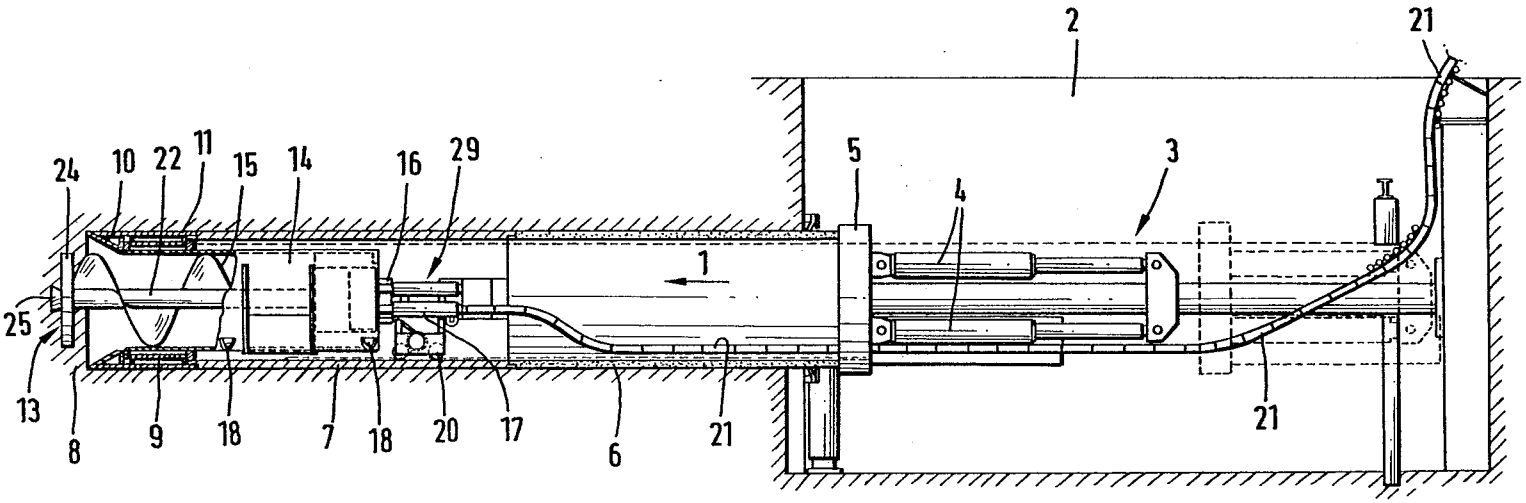
FIG. 1 is a diagrammatic sectional side view of the apparatus constructed in accordance with the invention.

As shown in FIGS. 1 to 5, pipe-driving apparatus serves to drive a pipe string 6 composed of a succession of individual pipe sections end-to-end in the driving direction of arrow 1. The pipe sections, usually prefabricated from concrete, are introduced into an open access trench 2 in which there is a pressing station 3 equipped with hydraulic rams 4 which act on a thrust ring 5. The fresh pipe section is aligned at the rear of the last pipe section in the pipe string 6 composed of the previously installed pipe sections and the entire pipe string 6 is thrust forwards in the direction of arrow 1 with the thrust ring 5 and rams 4. If the pipe string 6 is of considerable length intermediate press stations can be adopted in known manner.

Figure 2:
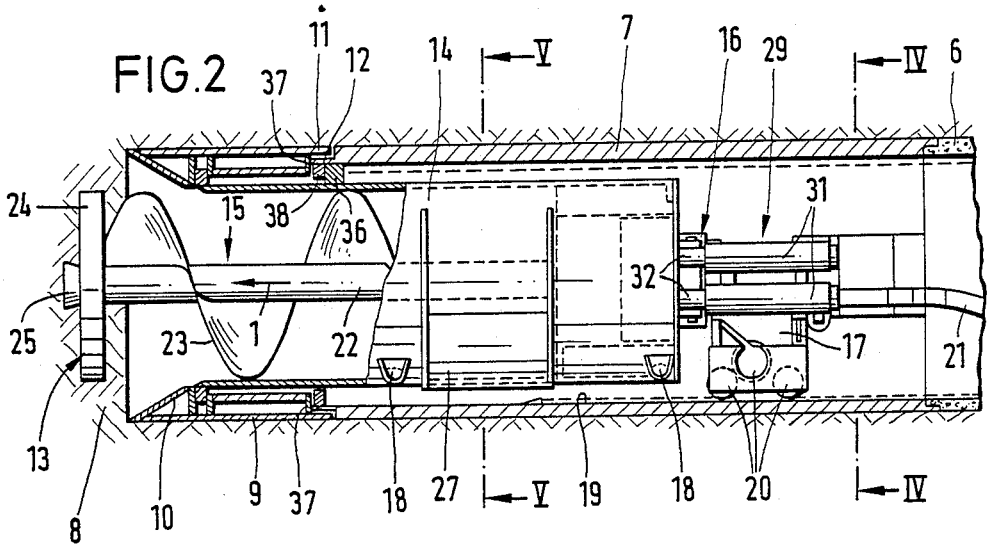
FIG. 2 is a diagrammatic sectional side view of a forward region of the apparatus the view being taken on a somewhat larger scale to FIG. 1.

As can best be seen in FIG. 2, at the front end zone of the pipe string 6 there is a special working pipe section 7 conveniently made from steel on which there is a cutting device such as a shoe 9 with a cutter 10. The rear portion 11 of the shoe 9 engages over an axial region of the pipe section 7 with a certain clearance to provide some angular mobility between the pipe section 7 and the shoe 9 and thereby permit directional control.

Figure 3:
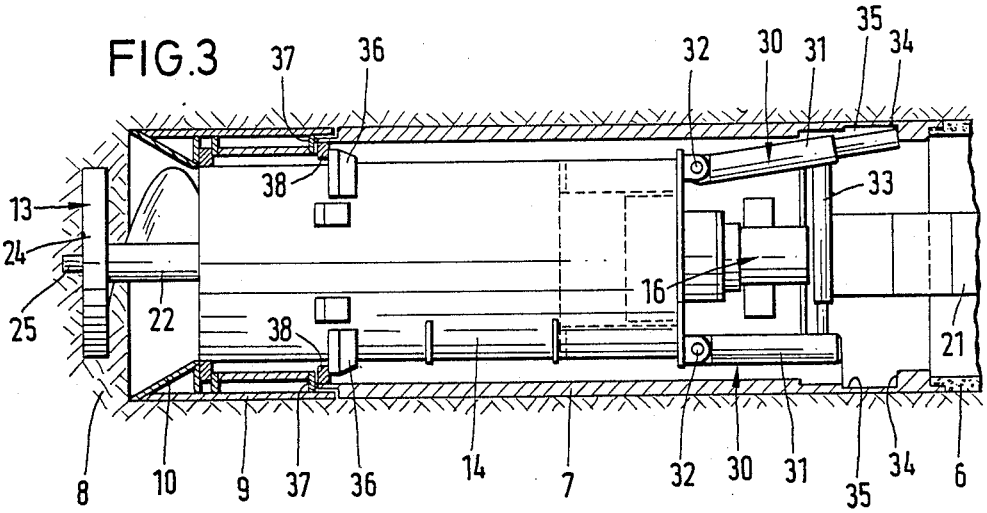
FIG. 3 is a diagrammatic sectional plan view of the forward region of the apparatus depicted in FIG. 2.

Spoil in the form of soil or other debris is detached from a working face 8 in front of the cutter 10 with a boring head 13 such as an auger. The detached spoil is removed with the aid of a displaceable container 14 and a conveyor worm 15 linked to the boring head 13 installed in the pipe section 7. The container 14 is of rigid steel construction, conveniently cylindrical, open towards the working face 8 and closed at its rear end. The container 14 supports the worm 15 and the head 13 for rotation and is shown in FIGS. 2 and 3, in its working position being filled with spoil as the head 13 and the worm 15 working together to transfer the spoil from the face 8 rearwardly into the container 14. To unload the spoil from the container 14 the latter is withdrawn along the pipe string 6 back into the trench 2.

A drive unit 16 connected to the container 14 serves to drive both the conveyor worm 15 and the boring head 13. Conveniently, the unit 16 drives a rotary shaft 22 which extends through the container 14 and bears a spiral flight 23 providing the worm 15 and to which the boring head 13 is secured. The latter can be embodied as a single replaceable cutter of optional design with an additional centering cutter 25 all mounted on a common carrier 24 fixed to the shaft 22. The unit 16 preferably incorporates means 17 for displacing the container 14, the head 13, the conveyor worm 15 and the unit 16. To facilitate this displacement the container 14 is equipped with running wheels 18 or the like which engage directly with the interior of the pipe section 7 and the other pipe sections although guide rails can be provided on which the container 14 can run. A cable or chain 19 acting as traction means is provided in the pipe string to displace the container 14 and the ancilliary parts and the means 17 would then incorporate drive and deflection i.e. guide wheels 20 for the cable 19.

Figure 5:
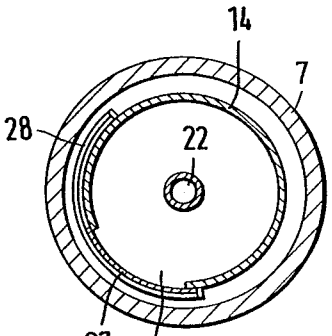
FIG. 5 is a cross-section taken along the line V—V of FIG. 2.

Energy is best supplied to the unit 16 by means of supply lines such as hydraulic flexible conduits or hoses 21 leading through the pipe string 6 back to the trench 2 or elsewhere to a pump and control unit. The hoses 21 are best wound around drums which take up and unreel the hoses as the container 14 is moved back and forth between its forward working position and the trench 2. When the container 14 is moved back into the trench 2 for unloading the spoil can be removed in various ways. For example, the container 14 could be simply tipped or turned about its axis or provided with an openable discharge aperture preferably at the bottom. The worm 15 can be run again to assist in unloading. FIG. 5 shows an aperture 26 in the container 14 closed by a flap 27 mounted on a guide 28 for pivoting or sliding.

Figure 4:
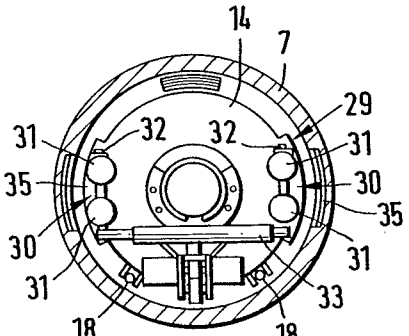
FIG. 4 is a cross-section taken along the line IV—IV of FIG. 2.

It is desirable to hold the container 14 in position whilst filling takes place and to achieve this bracing means 29 is provided at the rear of the container 14 near the unit 16. The container 14 is equipped with projections 36 on its front end conveniently spaced by 90° around the periphery of the container 14. These projections 36 are engageable with a shoulder 37 on the cutter shoe 9. The bracing means or device 29 is constructed as two assemblies 30 positioned on diametrically opposed sides of the container 14. Each assembly 30 is composed of two piston and cylinder units 31 mounted in generally parallel disposition with the axis of the pipe string 6. The units 31 are supported on pivot joints 32 with vertical axes permitting them to swing laterally. A further transverse piston and cylinder unit 33 serves to displace the assemblies 30 about the joints 32. As the unit 33 extends the units 31 are swung outwards to engage within recesses or pockets 35 in the interior of the pipe section 7. The rear ends of the recesses 35 form stops 34 for the units 31. When the units 31 are located against the stops 34 by the operation of the unit 33, the units 31 can be extended to urge the container 14 forwardly to bring the projections 36 against the shoulder 37 and effect the bracing operation. The bracing device 29 also permits the shoe 9 to be steered to some extent to correct any deviation in the pipe driving and any tendency for the string 6 to wander off course. To achieve this, lining pieces 38 of varying thickness are interposed between the projections 36 and the shoulder 37 to bring the axis of the shoe 9 into a desired location. The lining pieces 38 are best detachably fixed to the projections 36 when the container 14 is accessible in the trench 2. An alternative arrangement is to provide the projections 36 with some adjustment in the longitudinal direction of the container 14. When the container 14 is to be withdrawn back down the pipe string 6 to the trench, the unit 33 is retracted to swing the units 31 inwardly to free them from the stops 34. For illustrative purposes FIG. 4 shows the units 31 pivoted inwards into their inoperative position and FIG. 3 depicts the units 31 in the upper part in the operative position and in the lower part in the inoperative position.

Figure 6:
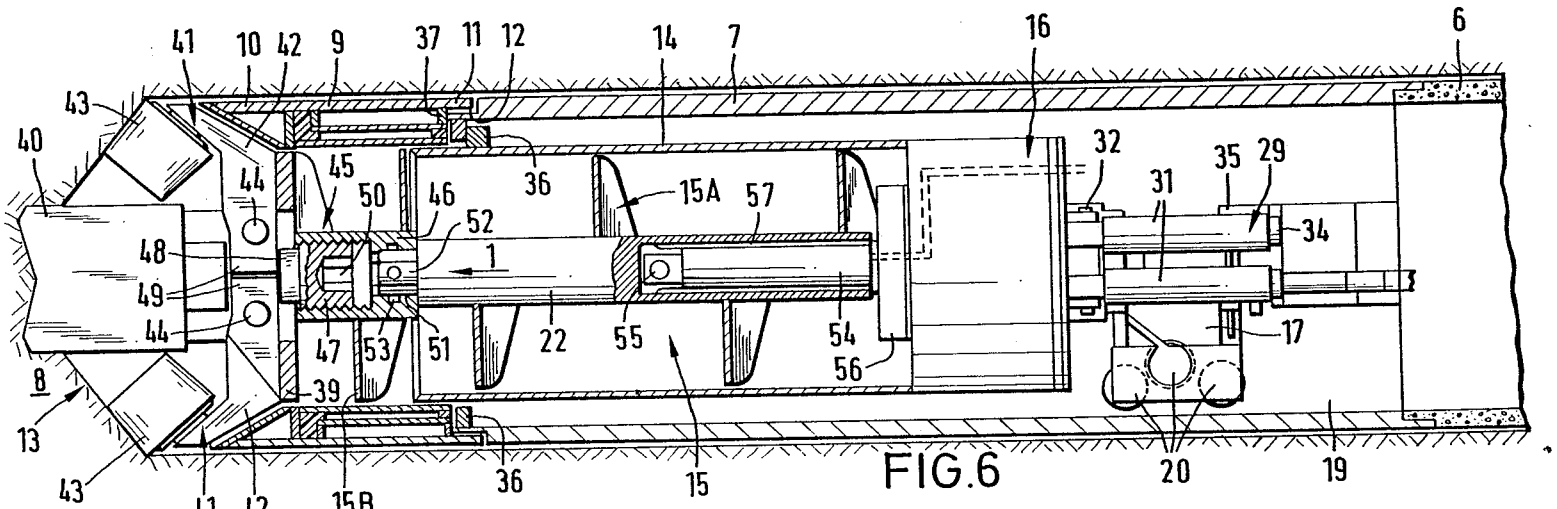
FIG. 6 is a view corresponding to FIG. 2 but showing the forward region of a modified form of the apparatus.
Figure 7:
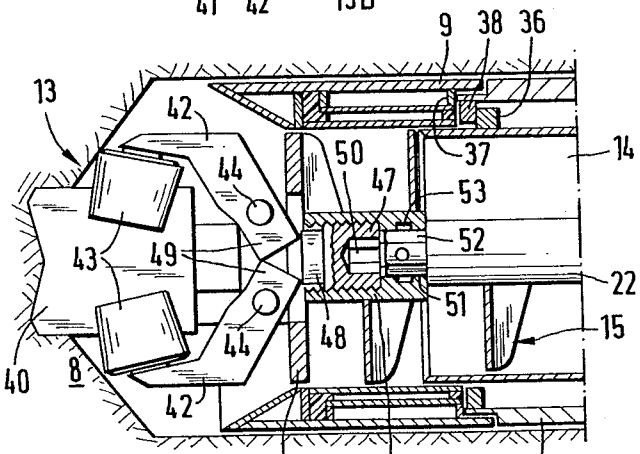
FIG. 7 is a diagrammatic sectional plan view of the boring head and coupling of the apparatus depicted in FIG. 6.

FIGS. 6 and 7 depict a modified arrangement using the same reference numerals as in FIGS. 1 to 5. The modified version, has inter alia, an improved version of the boring head 13 and its connection to the drive shaft 22. In this modified construction, the diameter of the boring head 13 is variable so that it can be expanded to perform an over cut in relation to the cutter 10 or it can be contracted to a diameter smaller than that of the shoe 9 and the pipe string 6. This enables the head 13 to be withdrawn more easily with the container 14 through the pipe string 6 back to the trench 2. In this design, the boring head 13 has a carrier 39 with a centre cutter 40 and a pair of cutting devices 41 movable radially inwards and outwards. The devices 41 consist of arms 42 mounted for swivelling on pivot joints 44 on the carrier 39 and supporting rollers, wheels or other cutting tools 43. A mechanism 45 serves to pivot the arms 42 about the joints 44 between an outer working position shown in FIG. 6 and an inner collapsed position shown in FIG. 7. The mechanism 45 is operated by the drive shaft 22. More particularly, the mechanism 45 employs an internally threaded sleeve 46 mounted and fixed to the rear of the carrier 39 in axial alignment with the shaft 22. An externally threaded adjustment member 47, engages in the sleeve 46 and acts through a thrust piece 48 to engage with the inner ends of the arms 42. The thrust piece 48 can be displaced axially by the member 47 to cause the arms 42 to pivot outwardly or inwardly and to hold the arm 42 in the set position. The adjustment member 47 is coupled to the shaft 22 via a selective slidable coupling. The coupling can be composed of a polygonal-shaped socket 50 in the member 47 which receives a correspondingly shaped projection of a tool connectable to the end of the shaft 22. By engaging the tool projection in the socket 50 the shaft 22 can be rotated in one direction or the other preferably at slow speed, to drive the adjustment member 47 along the sleeve 46 in one direction or the other. The tool projection can be engaged in the socket 50 when the container 14 is in the working i.e. filling position to urge the member 47 forwardly and swing the arms 42 outwardly.

The drive connection between the boring head 13 and the drive shaft 22 can also take the form of a selective slidable coupling similar to that used for adjustment of the arms 42. The sleeve 46 is thus provided with a polygonal-shaped socket 51 in an end wall which receives a correspondingly shaped tool projection 52 detachably fixed to the drive shaft 22. The socket 51 is larger than the socket 50 in the member 47 and penetrates through the end wall so that the other smaller tool projection used for displacing the member 47 within the sleeve 46 can pass through the socket 51. The engagement of the projection 52 in the socket 51 rotatably locks the carrier 39 to the shaft 22 to permit rotation of the boring head 13. When the container 14 is moved back to the trench 2 for unloading the boring head 13 can remain in its expanded working position at the face since the shaft 22 can be moved with the container 14 to disengage the projection 52 from the socket 51. Other forms of selective couplings such as latches are employed when it is desired to connect the boring head 13 to the shaft 22 to resist axial separation. Thus, the tool projection 52 can be supplemented by another tool projection of similar shape to the tool projection 52 but additionally equipped with spring biased pins which automatically latch into radial apertures 53 in the walls of the socket 51 when the special tool projection is introduced into the socket 51. By mounting this special tool projection onto the shaft 22 the tool projection can lock with the sleeve 46 to permit the boring head 13 to be displaced along the pipe string 6 with the container 14 and ancilliary equipment. The boring head 13 must first be collapsed to the position shown in FIG. 7 by displacement of the adjustment member 47. The boring head 13 would only need to be moved back into the trench 2 in the case of re-tooling or repair or other maintainence. The nature of the cutting appliances provided on the boring head can be changed to adapt to different operating conditions and the selective coupling between the head 13 and the container 14 means the head 13 can be left in place and only withdrawn in case of need. If the head 13 encounters a serious obstruction, the face 8 can be entirely exposed for inspection and appropriate remedies can be utilized.

As in the embodiment depicted in FIGS. 1 to 5, the shaft 22 carries a spiral flight which forms a conveyor worm 15 which transfers spoil from the head 13 and the shoe cutter 10 into the container 14. In this construction, the worm 15 is composed of a flight section 15A on the shaft 22 extending over substantially the entire length of the container 14 and a separate flight section 15B on the sleeve 46 extending between the head 13 and the open front end of the container 14. The forward flight section 15B is thus an integral part of the boring head 13. The entire assembly composed of the shaft 22, the boring head 13 and the worm with flight sections 15A, 15B, is displaceable forwardly and rearwardly along the container 14. This displacement is effected with a double-acting hydraulic piston and cylinder unit 54 accommodated in a hollow rear end portion of the shaft 22. The piston rod of the unit 54 is connected via a pivot joint 55 to the shaft 22 while the cylinder of the unit 54 is connected to a rotatable disc 56 driven by the drive unit 16. The disc 56 is provided with rotary duct means of known design for transferring pressure medium to and from the unit 54. The cylinder of the unit 54 is locked for rotation to the shaft 22 but axially displaceable relative to the shaft 22 as by a splined or toothed connection 57. By operating the unit 54 the head 13 and the worm flights 15A, 15B can be thrust forwards from the container 14 and the shoe 9 or moved back to provide adjustment of the pre-cut in front of the shoe 9. Also by retracting the head 13 and the worm 15 somewhat relative to the container 14 with the unit 54, spoil collecting in the container 14 can be compressed and the loading capacity of the container 14 can be optimized.

We claim:

1. Pipe-driving apparatus comprising: a pressing station in an access zone for thrusting a succession of pipe sections end-to-end to form a pipe string, a working pipe section at the front end of the pipe string defining a working zone, cutting means and a conveyor worm at the working zone for detaching material from a working face and for conveying such material away from the face, a displaceable container operably associated with the cutting means and the conveyor worm to receive said material, the cutting means taking the form of a rotatable boring head carried on a drive shaft extending through the container, the drive shaft being provided with a spiral flight constituting at least part of the conveyor worm, the cutting head being adjustable to vary its effective diameter by means of a mechanism connected to and operated by the drive shaft, the container being movable between the working and access zones to transfer the material, a drive unit for driving the cutting means and the conveyor worm, the drive unit being supported by the container, and bracing means which selectively cooperates with the working pipe section to brace the container and hold the container in position whilst it is filled with material.

2. Apparatus according to claim 1, wherein the bracing means comprises piston and cylinder bracing units.

3. Apparatus according to claim 2, wherein the bracing units are arranged on the container predominantly axially of the pipe string and a further piston and cylinder adjustment unit serves to pivot the bracing units between inoperative stowed positions and operative positions for engagement with stop means on the interior of the working pipe section.

4. Apparatus according to claim 1, and further comprising a cutting shoe mounted at the front end of the working pipe section nearest the working face for limited angular mobility.

5. Apparatus according to claim 4, and further comprising projection means on the container which engage with part of the cutting shoe when the bracing means is operated to thrust the container towards the working face.

6. Apparatus according to claim 5, wherein axial adjustment means is provided between the projection means and the engageable part of the cutting shoe to enable the cutting shoe to be positionally adjusted by the bracing means.

7. Apparatus according to claim 1, wherein the boring head has a carrier, a pair of arms pivotably mounted to the carrier and cutter tools mounted on the arms and the adjustment mechanism serves to pivot the arms radially outwards and inwards relative to the pipe string.

8. Apparatus according to claim 7, wherein the adjustment mechanism takes the form of an internally threaded sleeve mounted to the carrier and interengaging with an adjustment member disposed within the sleeve, the adjustment member acting on the arms to effect pivot movement thereof as it moves along the sleeve in response to rotational drive.

9. Apparatus according to claim 8, wherein a selective coupling is provided to connect the drive shaft to the adjustment member to impart rotational drive, said coupling taking the form of a tool projection attachable to the drive shaft and a socket in the adjustment member for receiving the tool projection.

10. Apparatus according to claim 1, wherein a variety of attachments are provided for mounting to the drive shaft, one of these attachments enabling the drive shaft to operate the boring head adjustment mechanism, another of these attachments enabling the drive shaft to be coupled to the boring head for common rotation but axial separation and a further attachment for locking the drive shaft in the boring head to permit the boring head to be displaced away from the working zone with the container.

11. Apparatus according to claim 1, wherein means is provided to displace the conveyor worm relative to the container in the direction of the axis of the pipe string.

12. Apparatus according to claim 1, wherein there is further provided means for displacing the drive shaft axially relative to the container.

13. Apparatus according to claim 1, wherein the shaft displacement means takes the form of a piston and cylinder unit mounted within the shaft via a splined connection, the unit being operably connected between the shaft and a rotatable disc driven by the drive unit and equipped with rotary duct means for transferring pressure fluid to and from the unit.

14. Apparatus according to claim 1, wherein a further flight section is disposed between the boring head and the drive shaft, the further flight section cooperating with the spiral flight on the drive shaft but being separable therefrom.

15. Apparatus according to claim 14, wherein the spiral flight extends over substantially the entire length of the container and the container is provided with one or more openable apertures for facilitating the unloading and discharge of material.

16. Apparatus according to claim 1 wherein the mechanism is detachably connected to the drive shaft.

17. Pipe-driving apparatus comprising: a pressing station in an access zone for thrusting a succession of pipe sections end-to-end to form a pipe string, a working pipe section at the front end of the pipe string defining a working zone, cutting means and a conveyor worm at the working zone for detaching material from a working face and for conveying such material away from the face, a displaceable container operably associated with the cutting means and the conveyor worm to receive said material, the cutting means taking the form of a rotatable boring head carried on a drive shaft extending through the container, the drive shaft being provided with a spiral flight constituting at least part of the conveyor worm, coupling means for coupling the drive shaft to the boring head selectively to permit relative axial separation while inhibiting relative rotation therebetween, the container being movable between the working and access zones to transfer the material, a drive unit for driving the cutting means and the conveyor worm, the drive unit being supported by the container, and bracing means which selectively cooperates with the working pipe section to brace the container and hold the container in position whilst it is filled with material.

18. Apparatus according to claim 17, wherein the coupling takes the form of a socket in part of the boring head and a tool projection attachable to the drive shaft and engageable in the socket.

19. Pipe-driving apparatus comprising: a pressing station in an access zone for thrusting a succession of pipe sections end-to-end to form a pipe string, a working pipe section at the front end of the pipe string defining a working zone, cutting means and a conveyor worm at the working zone for detaching material from a working face and for conveying such material away from the face, a displaceable container operably associated with the cutting means and the conveyor worm to receive said material, the cutting means taking the form of a rotatable boring head carried on a drive shaft extending through the container, the drive shaft being provided with a spiral flight constituting at least part of the conveyor worm, coupling means for connecting and locking the drive shaft to the boring head to cause the boring head to move axially and rotatably with the drive shaft, the container being movable between the working and access zones to transfer the material, a drive unit for driving the cutting means and the conveyor worm, the drive unit being supported by the container, and bracing means which selectively cooperates with the working pipe section to brace the container and hold the container in position whilst it is filled with material.

20. Apparatus according to claim 19, wherein the coupling means takes the form of a socket in part of the boring head and a tool projection attachable to the drive shaft, the tool projection being engageable in the socket and having spring loaded pins which lock into the socket automatically.

* * * * *